US005791910A

United States Patent [19]

Masson et al.

[11] Patent Number: 5,791,910

[45] Date of Patent: Aug. 11, 1998

[54] REUSABLE WRITING BOARD HAVING SINGLE POLYESTER OVERLAY SHEET

[75] Inventors: Daniel P. Masson, Burr Ridge; Jeffrey E. Bradley, Barrington; Tom Boursaw, Lake Forest; Mike Vukmir, Brookfiled, all of Ill.

[73] Assignee: Colonial Converting Corporation, Des Plaines, Ill.

[21] Appl. No.: 917,541

[22] Filed: Aug. 26, 1997

[51] Int. Cl.[6] ..... B43L 1/12

[52] U.S. Cl. ..... 434/410; 434/416

[58] Field of Search ..... 434/408, 410, 434/416, 415

[56] References Cited

U.S. PATENT DOCUMENTS

| | | | |
|---|---|---|---|
| 233,597 | 11/1880 | Strauss | 434/410 |
| 1,455,579 | 5/1923 | Evans | 434/410 |
| 4,051,609 | 10/1977 | Boursaw . | |
| 5,098,502 | 3/1992 | Smolinski | 434/410 X |

*Primary Examiner*—Jeffrey A. Smith
*Attorney, Agent, or Firm*—Hill & Simpson

[57] ABSTRACT

A pressure sensitive reusable writing board is provided which includes a backing layer printed with a background color and coated with wax and a single polyester sheet attached to a wax-free strip of the backing and which overlies the wax layer. Pressure applied to a front surface of the polyester sheet causes the sheet to cling to the wax layer thereby showing the writing as a dark color (i.e., the color of the wax) on a white or light background. The white or light background is provided by printing on the undersurface of the polyester sheet with a white opaque finish. Graphics, such as lines, maps or other educational or functional graphics may be disposed on the undersurface of the sheet. The backing may also be mounted onto a larger panel which may include additional informational or decorative graphic presentations.

19 Claims, 2 Drawing Sheets

REUSABLE WRITING BOARD HAVING SINGLE POLYESTER OVERLAY SHEET

BACKGROUND OF THE INVENTION

The present invention relates generally to reusable pressure sensitive writing boards commonly referred to as "slate boards" or "magic slates", of the type which are frequently used by children. More specifically, the present invention relates to a pressure sensitive reusable writing board having a wax coated surface against which a film is caused to adhere by appropriate engagement by a writing implement as set forth in, e.g., U.S. Pat. No. 4,051,609.

Currently available reusable writing boards typically include two separate films or plastic sheets overlaying a wax coated backing. Specifically, the outer sheet, approximately 2–3 mil thick, is fabricated from clear polyester and provides a smooth, glossy surface. The inner sheet, approximately 1 mil thick, is fabricated from opaque polypropylene. The inner polypropylene sheet is required to provide an opaque sheet which will stick to the wax layer.

In operation, the front sheet is engaged by a writing instrument which presses both sheets towards the wax coating. The lower sheet then adheres or clings to the wax coating thereby providing the writing pattern as a dark color (i.e., the color of the board) on a white or whitish background wherever the lower sheet adheres to the wax coating. The writing remains visible until the sheets are lifted from the waxy surface thereby erasing the writing and readying the board for additional use.

The smooth outer surface provided by the polyester is film used to provide a durable writing surface. While toy pens or pencils are typically provided with reusable writing boards, children will often use a real pen or pencil on the outer sheet. The polyester sheet resists permanent markings made by a real pen or pencil. Further, such polyester films are more resistant to developing creases. In other words, polyester sheets exhibit less of a creasing or folding memory. However, polyester does not stick well to the waxy undersurface. Accordingly, the additional polypropylene inner sheet is used. The additional polypropylene sheet is further required because it is not practical to apply a partially-transparent white coating to the undersurface of a polyester sheet. Polypropylene sheets are much more suitable for accommodating the opaque white coating.

Writing boards having only a single polyester sheet have been provided in the past. However, single polyester sheets were not preferred because the polyester did not adequately stick to the waxy undersurface.

Typically, the polypropylene and polyester sheets are attached to the panel or backing layer by staples or by being glued to the panel or backing layer. An additional cover layer is disposed over the glued part of the sheet in order to hold it in place and prevent the sheet from being torn off of the panel. A method of attaching the sheet to the panel is disclosed in U.S. Pat. No. 4,051,609.

In order to provide color to the wax layer, the backing has traditionally been dyed or printed with printing inks.

SUMMARY OF THE INVENTION

The present invention provides a reusable pressure-sensitive writing board that includes a backing member having a front side printed with a background color and which is at least partially coated with a wax layer that serves as a writing surface. The wax layer is thereafter covered with a single polyester film which includes a front side for engaging a writing instrument and a rear side that engages the wax layer. The rear side of the polyester film is printed with a white or whitish color to provide a partially transparent effect, i.e., an opaque white effect. The rear side may also be printed with graphical material such as lines intended to simulate lined paper.

In an embodiment, the wax layer is deposited onto the backing in an amount ranging from about 0.064 ounces per square foot to about 0.075 ounces per square foot. In other words, the wax layer is deposited in an amount ranging from 12 pounds per ream (24"×36"×500") to about 14 pounds per ream.

In an embodiment, the upper edge of the polyester film is attached with glue to a wax-free strip of the backing sheet.

In an embodiment, the glue that attaches the upper edge or margin of the polyester film to the backing is a water-based glue.

In an embodiment, the polyester film has a thickness ranging from about 1 mm to about 3mm.

In an embodiment, the polyester film has a thickness of about 2mm.

In an embodiment, the upper margin of the polyester film is printed with a color on the rear side of the film. The printed color effectively hides the glue that attaches the upper margin of the polyester film to the backing.

In an embodiment, the upper margin of the polyester film, which is glued to the backing, is approximately 3/16" wide.

In an embodiment, the wax used for the wax layer is paraffin.

In an embodiment, the backing is further attached to a panel which extends beyond the backing and provides front and rear surfaces for the display of graphical and decorative indicia.

It is therefore an advantage of the present invention to provide a reusable pressure-sensitive writing board which requires a single film disposed over the wax layer.

Yet another advantage of the present invention is that it provides a reusable pressure-sensitive writing board with a single film layer with graphical material, such as lines, maps or other information printed on the rear side of the film.

Yet another advantage of the present invention is that it avoids the use of two films disposed over the wax layer as required by prior art reusable writing boards.

Another advantage of the present invention is that it provides a reusable pressure-sensitive writing board that utilizes a single layer of polyester or a single film which presents a smooth outer surface and an inner surface which effectively adheres to a wax layer.

Still another advantage of the present invention is that it provides an improved wax layer which effectively adheres to a polyester film.

Other objects and advantages of the present invention will become apparent upon a review of the attached drawings and detailed description of the presently preferred embodiments, and upon reference to the appended claims.

BRIEF DESCRIPTION OF THE DRAWINGS

This invention is illustrated more or less diagrammatically in the accompanying drawings, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
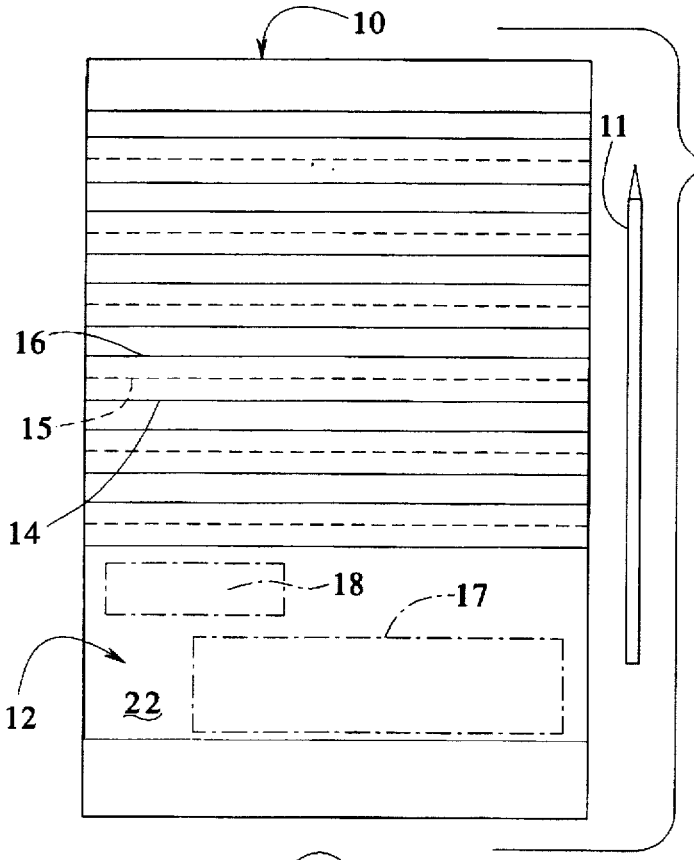
FIG. 1 is an elevational view of a reusable pressure-sensitive writing board made in accordance with the present invention.

Turning first to FIG. 1, a reusable pressure-sensitive writing board 10 is illustrated with an accompanying stylus 11. The stylus preferably is not a traditional writing instrument; it is simply a pointed tool, preferably wooden, used to press the polyester sheet 12 into the layer of wax shown at 13 in FIG. 2. Of course, the stylus 11 may be made out of other material such as plastic or metal. The layer of wax 12 coats the backing 21 which is pre-printed with one or more colors. The backing 21 preferably is a 12 pt to 24 pt solid bleached sulfite board.

Returning to FIG. 1, the polyester sheet 12 includes a plurality of indicia such as lines 14, 15 and 16 for training children how to write on lined paper. The space from lines 14 to 16 for training children how to write capital letters on lined paper and the space from lines 14 to 15 for training children how to write lowercase letters on lined paper. The boxes shown at 17 and 18 may be used for training children how to address an envelope. The address of the addressee being written in the box 17 and the return address being written in the box 18.

Figure 2:
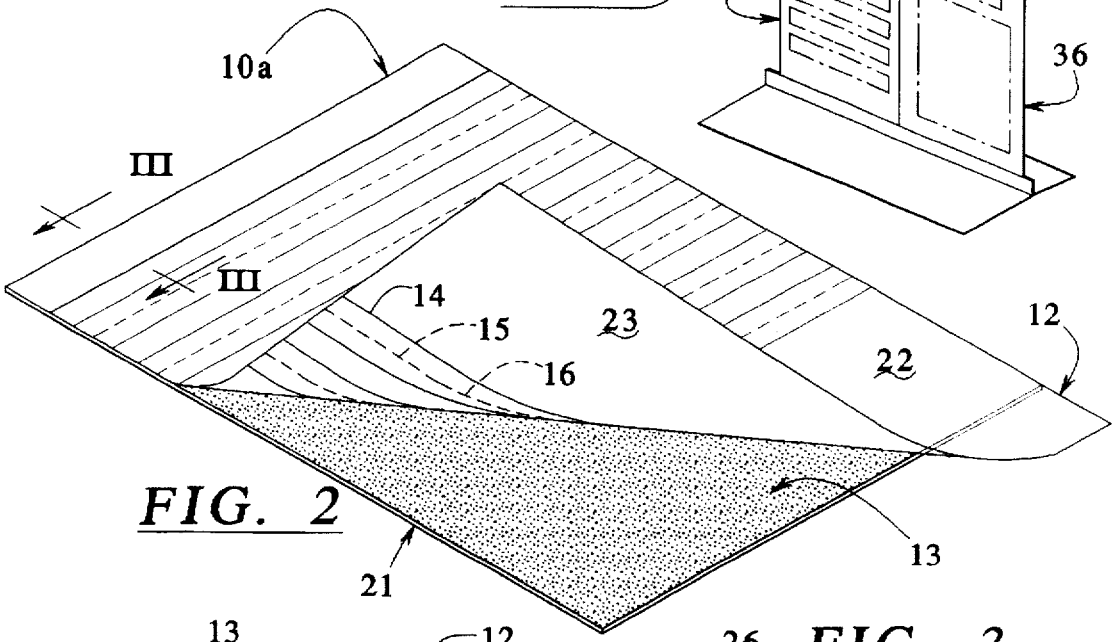
FIG. 2 is a perspective view of a writing board made in accordance with the present invention, with a bottom corner of the polyester film turned upward to expose the wax layer disposed on the backing.

Turning to FIG. 2, the board 10*a* includes a lower backing member 21 on which a layer of wax 13 is deposited. The wax is preferably paraffin and is deposited in an amount so that 12 to 14 pounds of wax are applied per ream of backing material 21. In terms of ounces per square foot, the wax is deposited in an amount ranging from 0.064 ounces per square foot to about 0.075 ounces per square foot. The wax should also be deposited in a smooth and uniform manner. Such methods of depositing wax will be apparent to those skilled in the art.

The sheet 12 is a single polyester sheet having a smooth upper side 22 and a lower or rear side 23 that has been treated so it will accommodate printing, such as the lines 14, 15 and 16 as well as an overall white which imparts an opaque or partially transparent coating which provides a whitish hue to the sheet 12. By providing the overall white printing when the stylus 11 is used to press the sheet 12 onto the wax layer 13, thereby cause the sheet to stick to the wax layer 12 at the pressure point or line, the resulting pattern looks like dark ink in the color, or colors of the printed backing material 21 on white paper and therefore provides a realistic simulation for the child.

The polyester layer or film 12 preferably is printed on a standard flexographic press using a vulcanized cylinder for the continuous coverage and standard flexo plates for additional copy. The film 12 is reverse printed with the solid lines, any desired graphics and the overall white whose viscosity is adjusted to meet the opacity standards required for end use.

Figure 3:
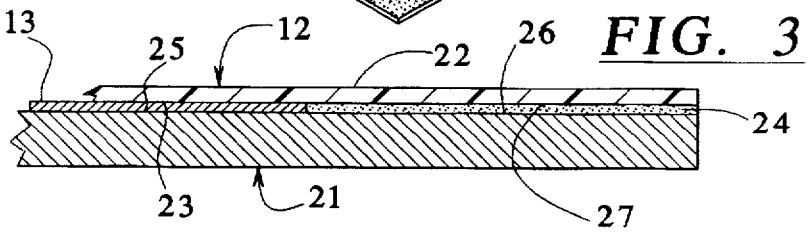
FIG. 3 is a sectional view taken substantially along line 3—3 of FIG. 2.

Turning to FIG. 3, the sheet 12 is attached to the backing 21 with a water-base adhesive 24. Specifically, the backing 21 includes an upper surface 25 that is coated with the wax layer 13. However, a wax-free strip 26 is provided at the upper end of the backing 21 as shown in FIG. 3. This wax-free strip 26 is coated with the water-based adhesive or glue 24. The sheet 12 extends beyond the wax layer 13 and over the wax-free strip 26 and adhesive layer 24 thereby resulting in the attachment of the sheet 12 to the backing 21.

In a preferred embodiment, the rear side 27 of the upper margin of the sheet 12 that is glued to the wax-free strip 26 of the backing 21 is printing with a color thereby hiding the glue layer 24 from view. The opaque coloring of the upper margin 27 also provides a neat colored border at the top of the sheet 12 for an improved aesthetic appearance.

The polyester film 12 can range in thickness form 1 mm to 3mm and preferably is about 2mm thick. Only the underside 23 is treated for printing. Accordingly, while the lines 14,15 and 16 are visible from the top side 22 of the sheet 12, the lines 14,15 and 16 are printed on the underside 23 of the sheet 12. The coloring of the upper margin 27 is also printed on the underside 23. Preferably, the colorization of the margin 27 and the graphics such as the lines 14, 15, 16 and boxes 17, 18 are printed before the opaque white effect is printed. However, printing may take place in any order or simultaneously.

Figure 4:
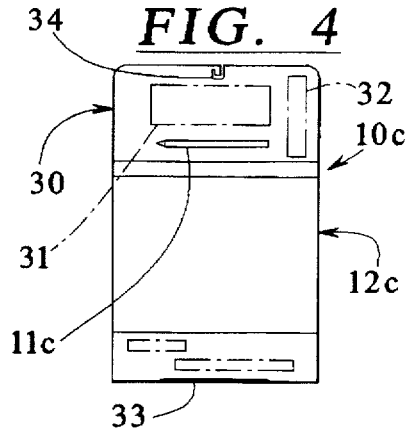
FIG. 4 is a front elevational view of another reusable pressure-sensitive writing board made in accordance with the present invention.

As illustrated in FIGS. 4–10, the reusable writing board of the present invention may be provided in a variety of embodiments. In FIG. 4, a writing board 10*c* is illustrated where the backing 21 (not shown in FIG. 4 because it is covered by the sheet 12) is mounted to a panel 30 which extends above the backing 21 to provide room for additional graphics 31, 32 and a place to mount the stylus 11. A cut out is provided at 33 for facilitating the grasping of the lower end of the sheet 12. The cut out shown at 34 is for hanging the board 10*c* on a bar rack in a retail store.

Figure 5:
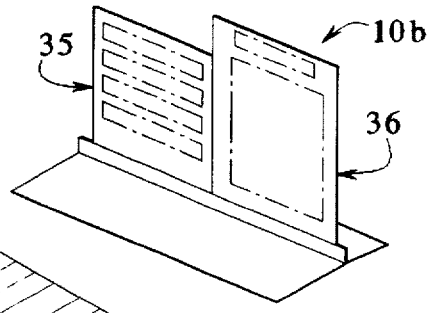
FIG. 5 is a perspective view of yet another reusable pressure-sensitive writing board made in accordance with the present invention.

A desk-top calendar-type writing board 10*d* is shown in FIG. 5. Reusable pressure-sensitive writing boards may be provided on either panel 35 or 36, or both. One panel, such as 36 may include a calendar while the other panel 36 may include a pressure-sensitive writing board for making notes.

Figure 6:
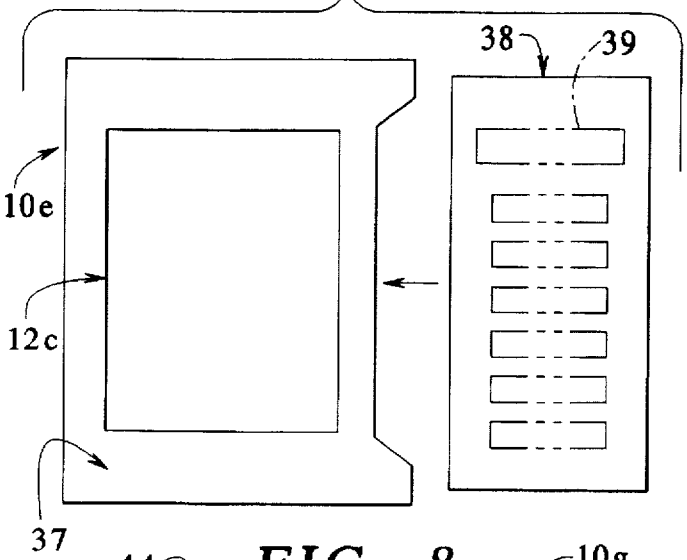
FIG. 6 is a front elevational view of another reusable pressure-sensitive writing board made in accordance with the present invention and further illustrated with an instructional card that may be disposed in a pocket formed between two panel members of the writing board.
Figure 7:
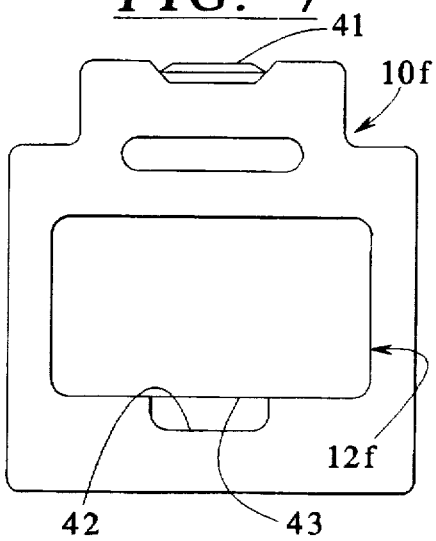
FIG. 7 is a front elevational view of another reusable pressure-sensitive writing board made in accordance with the present invention.
Figure 8:
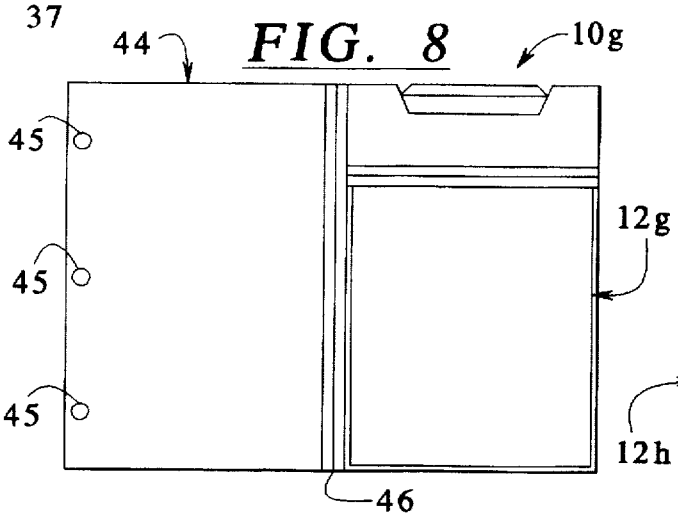
FIG. 8 is a front elevational view of another reusable pressure-sensitive writing board made in accordance with the present invention.
Figure 9:
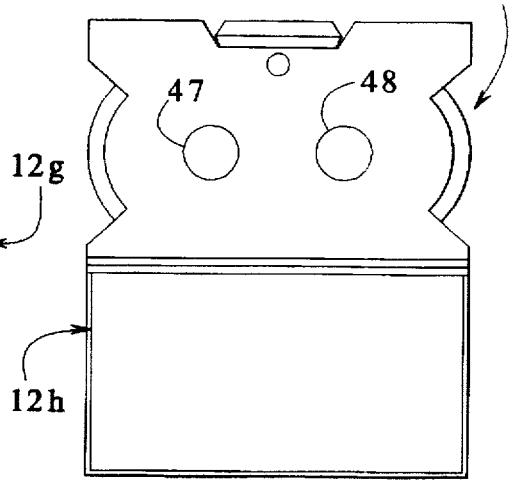
FIG. 9 is a front elevational view of another reusable pressure-sensitive writing board made in accordance with the present invention.
Figure 10:
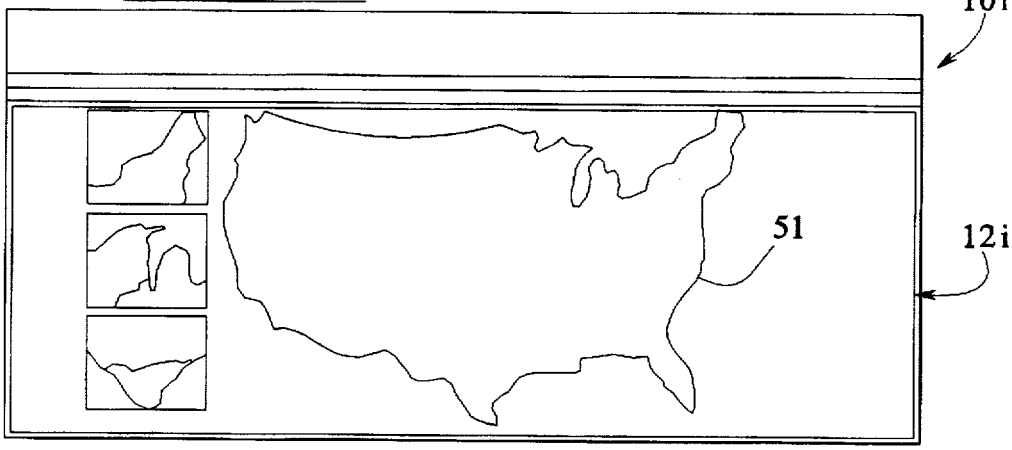
FIG. 10 is a front elevational view of another reusable pressure-sensitive writing board made in accordance with the present invention.

In FIG. 6, a pressure-sensitive reusable writing board 10*e* is shown which includes a front panel 37 that is attached to a rear panel (not shown). A pocket is provided between the two panels for an instructional card 38. Graphics 39, such as math problems or questions may be printed onto the card 38 and the answers may be written on the sheet **12*e*. Turning to FIG. 7, a similar writing board 10*f* is illustrated in the form of a travel slate. A clip shown at 41 may be used to attach the board 10*f* to the visor of a car and the sheet 12*f* provides a place for writing notes. An indent 42 is provided for facilitating the grasping of the lower edge 43 of the sheet 12*f*. In FIG. 8, a writing board 10*g* is mounted onto a panel 44 which includes a plurality of holes for attaching the panel 44 and writing board 10*g* into a three-ring binder. A fold is provided at 46 for folding the portion of the panel 44 accommodating the sheet 12*g* toward the holes shown at 45 so that the board 10*g* will fit into a standard three-ring binder (not shown). In FIG. 9, a writing board 10*h* is provided which may include spinner disks shown at 47, 48 disposed above the polyester sheet 12*h*. In FIG. 10, a board 10*i* is provided wherein the graphics disposed on the underside of the sheet 12*i* form a map. The board 10*i* is educational because the child user can practice writing in the names of states and cities over the graphics shown generally at 51. In addition to the map shown at 51, other charts may be provided for educational or entertainment purposes. Further, the graphics disposed of the underside 23 of the sheets shown generally at 12** may be used for greeting cards, memos, reminders, promotions or game score pads in addition to the educational and entertainment purposes discussed above.

Although only a limited number of embodiments of the present invention have been illustrated and described, it will at once be apparent to those skilled in the art that variations may be made within the spirit and scope of the present invention. Accordingly, it is intended that the scope of the present invention be limited solely by the hereafter appended claims and not by any specific wording in the foregoing description.

What is claimed is:

1. A reusable pressure-sensitive writing board comprising:

a backing comprising a front side that is printed with at least one background color and that is at least partially coated with a wax layer, the wax layer being deposited onto the backing in an amount ranging from about 0.064 oz/ft$^2$ to about 0.075 oz/ft$^2$, a single sheet of polyester film overlaying the front side of the backing, the polyester film comprising a front side for engaging a writing instrument and a rear side that engages the wax layer, the rear side of the polyester film being treated for printing, the rear side of the polyester film being printed with graphical material and the rear side of the film further being printed to provide an opaque white appearance.

2. The writing board of claim 1 wherein the backing has a wax free portion and the film is secured to the backing with glue at the wax free portion.

3. The writing board of claim 2 wherein the film is glued to the backing with a water-base glue.

4. The writing board of claim 2 wherein the film comprises an upper margin, the upper margin being printed with a color on the rear side of the film which is effective to mask the glue from view.

5. The writing board of claim 1 wherein the film has a thickness ranging from about 1 mm to about 3 mm.

6. The writing board of claim 1 wherein the film has a thickness of about 2 mm.

7. The writing board of claim 1 wherein the film comprises an upper margin that is about 3/16" wide, the rear side of the film at the upper margin being glued to the backing with a water-based adhesive.

8. The writing board of claim 1 wherein the film comprises an upper margin that is about 3/16" wide, the rear side of the film at the upper margin being glued to the backing with a water-based adhesive, the upper margin being printed with a color on the rear side of the film at the upper margin, said color printing being effective to mask the glue from view.

9. The writing board of claim 1 wherein the wax layer comprises paraffin.

10. The writing board of claim 1 wherein the backing comprises a rear side that is mounted to panel, the panel comprising an outer that extends beyond the backing, the outer portion of the panel comprising a front surface for the display of indicia, the panel further comprising a rear surface for the display of indicia.

11. A reusable pressure-sensitive writing board comprising:

a backing comprising a front side that is printed with at least one background color and that is at least partially coated with a wax layer, the backing further comprising a wax-free strip, the wax layer is deposited onto the backing in an amount ranging from about 0.064 oz/ft$^2$ to about 0.075 oz/ft$^2$, the wax layer being engaged by a single-layer polyester film, the polyester film overlying the wax layer, the polyester film comprising a front side for engaging a writing instrument and a rear side that engages the wax layer, the rear side of the film being treated for printing, the rear side of the film being printed with graphical material and the rear side of the film being printed to provide the rear side with a partially opaque white appearance, the film having a thickness ranging from about 1 mm to about 3 mm, the film comprising an upper margin, the rear side of the film at the upper margin being disposed in matching registry with and glued to the wax-free strip of the backing, the upper margin being printed with a color on the rear side of the film at the upper margin which is effective to mask the glue from view.

12. The writing board of claim 11 wherein the upper margin of the film is glued to the backing with a water-base glue.

13. The writing board of claim 12 wherein the backing is further characterized as being solid bleached sulfite ranging from 12 pt. to 24 pt. in weight.

14. The writing board of claim 11 wherein the film has a thickness of about 2 mm.

15. The writing board of claim 11 wherein the upper margin of the film is about 3/16" wide.

16. The writing board of claim 11 wherein the backing comprises a rear side that is mounted to panel, the panel comprising an outer that extends beyond the backing, the outer portion of the panel comprising a front surface for the display of indicia, the panel further comprising a rear surface for the display of indicia.

17. A reusable pressure-sensitive writing board consisting essentially of:

a backing having a front side that is printed with at least one background color and that is at least partially coated with a wax layer, the backing further having a wax-free strip, the wax layer is deposited onto the backing in an amount ranging from about 0.064 oz/ft$^2$ to about 0.075 oz/ft$^2$, the wax layer being removably covered with a single-layer polyester film, the polyester film having a front side for engaging a writing instrument and a rear side that engages the wax layer, the rear side of the film being treated for printing, the rear side of the film being printed with graphical material and the rear side of the film being coated with a partially transparent white coating, the film has a thickness ranging from about 1 mm to about 3 mm, the film further having an upper margin, the rear side of the film at the upper margin being glued to wax-free strip of the backing, the upper margin being colorized with a colored coating disposed on the rear side of the film at the upper margin.

18. The writing board of claim 17 wherein the upper margin of the film is glued to the backing with a water-base glue.

19. The writing board of claim 17 wherein the film has a thickness of about 2 mm.

* * * * *

UNITED STATES PATENT AND TRADEMARK OFFICE

CERTIFICATE OF CORRECTION

PATENT NO. : 5,791,910

DATED : August 11, 1998

INVENTOR(S) : Daniel P. Masson et al

It is certified that error appears in the above-identified patent and that said Letters Patent is hereby corrected as shown below:

Col. 4, line 40, delete "form" and insert --from-- therefor

Col. 4, line 64, delete "as 36" and insert --as 35-- therefor

Col. 6, line 13, delete "to panel" and insert --to a panel-- therefor

Col. 6, line 14, delete "an outer" and insert --an outer portion-- therefor

Col. 7, line 11, delete "wax-free" and insert --the wax-free-- therefor

Signed and Sealed this

Seventeenth Day of August, 1999

*Attest:*

Q. TODD DICKINSON

*Attesting Officer*

*Acting Commissioner of Patents and Trademarks*